US008869760B2

(12) United States Patent
Knezek

(10) Patent No.: US 8,869,760 B2
(45) Date of Patent: Oct. 28, 2014

(54) HYDRAULIC VALVE ACTUATOR SYSTEM AND ENGINE INCORPORATING SAME

(71) Applicant: Ameriband, LLC, Arlington, TX (US)

(72) Inventor: Robert A. Knezek, Arlington, TX (US)

(73) Assignee: Ameriband, LLC, Arlington, TX (US)

( * ) Notice: Subject to any disclaimer, the term of this patent is extended or adjusted under 35 U.S.C. 154(b) by 0 days.

(21) Appl. No.: 13/837,421

(22) Filed: Mar. 15, 2013

(65) Prior Publication Data

US 2014/0261262 A1 Sep. 18, 2014

(51) Int. Cl.
*F01L 1/34* (2006.01)
*F01L 9/02* (2006.01)

(52) U.S. Cl.
CPC ..... *F01L 9/023* (2013.01)
USPC ..... 123/90.16

(58) Field of Classification Search
USPC ..... 123/90.16, 90.12, 90.48
See application file for complete search history.

(56) References Cited

U.S. PATENT DOCUMENTS

2002/0157624 A1* 10/2002 Janak ..... 123/90.12

* cited by examiner

*Primary Examiner* — Zelalem Eshete
(74) *Attorney, Agent, or Firm* — Howison & Arnott, L.L.P.

(57) ABSTRACT

A hydraulic valve actuator system comprises an actuator assembly including a housing and a piston disposed in a cavity of the housing and biased away from the housing, a pipe having a distal end connected to an outlet port of the actuator housing, and a valve follower assembly including a housing connected to the proximal end of the pipe and a piston disposed in a cavity of the housing and biased away from the housing. Movement of the actuator piston from a first to a second position causes hydraulic fluid to flow out of the actuator assembly, through the pipe, and into the follower assembly such that the follower piston moves from its first to its second position. Movement of the actuator piston from a second to a first position causes hydraulic fluid to reverse flow such that the follower piston moves from its second to its first position.

7 Claims, 4 Drawing Sheets

FIG. 2a
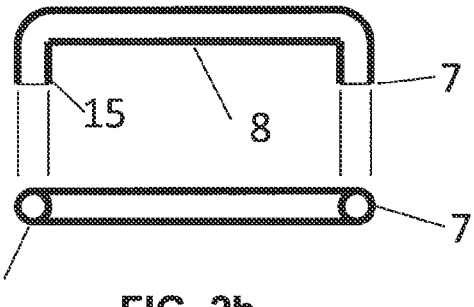
FIG. 2b
FIG. 3a
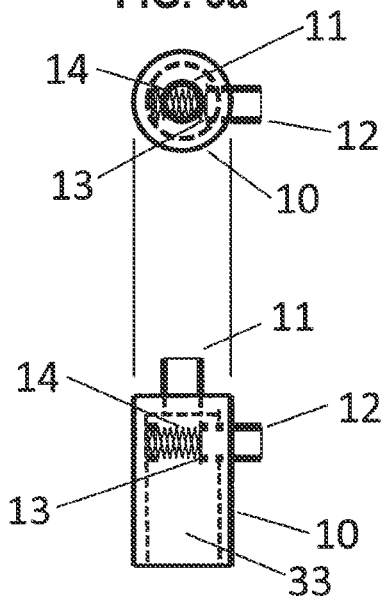
FIG. 3b
FIG. 4a
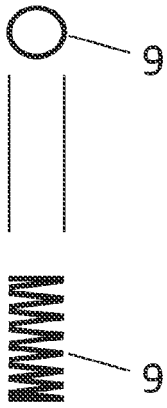
FIG. 4b
FIG. 5a
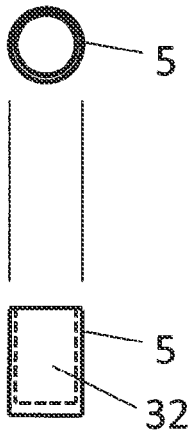
FIG. 5b
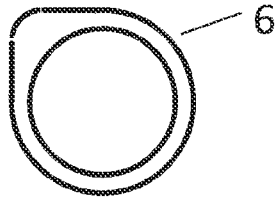
FIG. 6

FIG. 7a
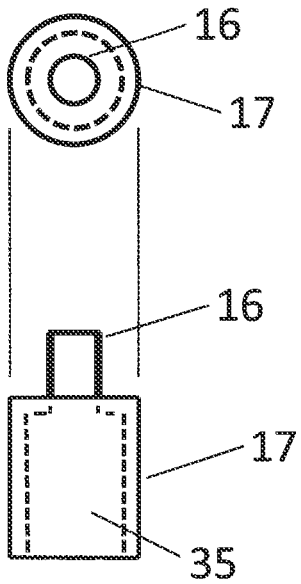
FIG. 7b
FIG. 8a
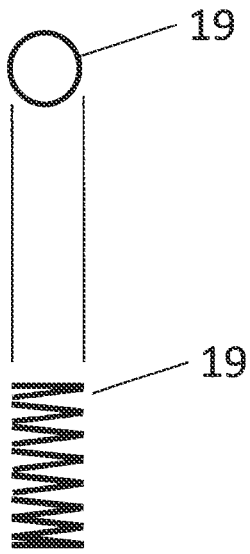
FIG. 8b
FIG. 9a
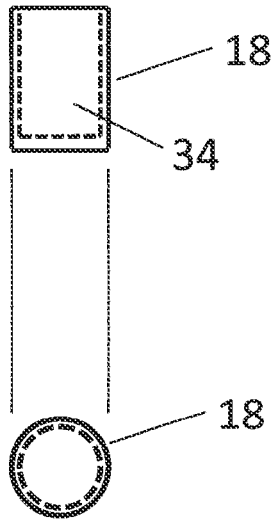
FIG. 9b

FIG. 10a
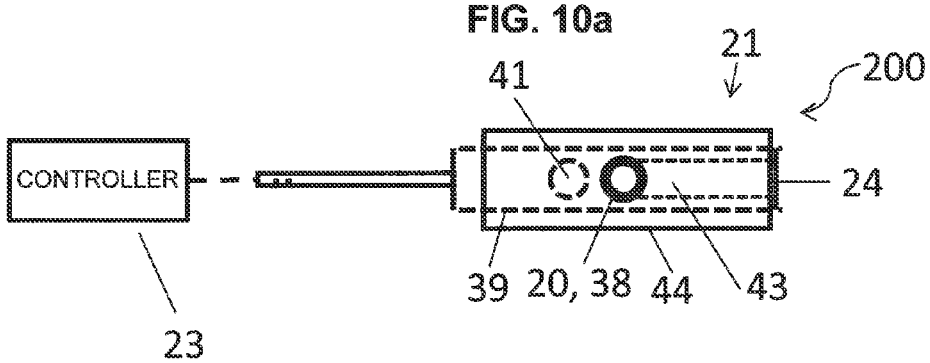
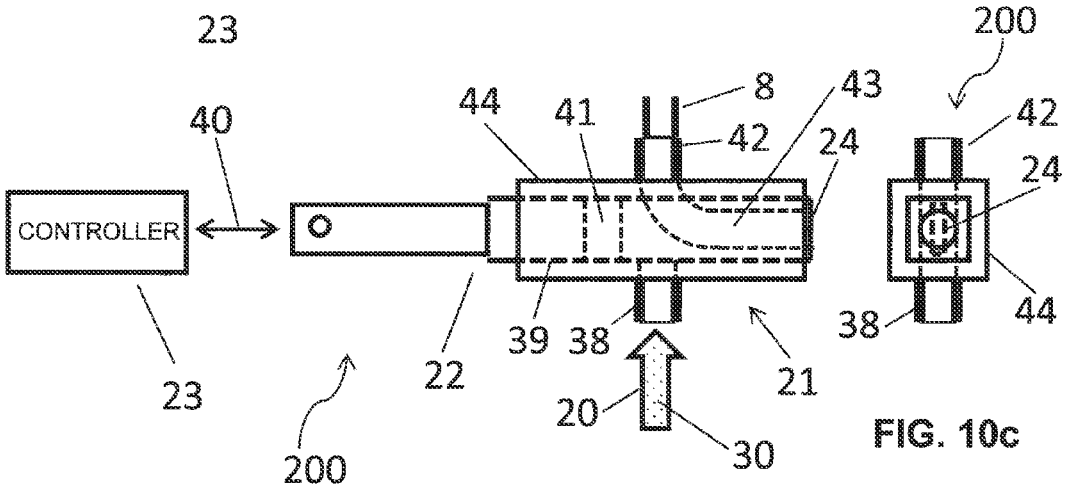
FIG. 10b
FIG. 10c

HYDRAULIC VALVE ACTUATOR SYSTEM AND ENGINE INCORPORATING SAME

TECHNICAL FIELD

The present invention relates to a valve actuator system for an internal combustion piston engine. In particular, it relates to a valve actuator system that utilizes hydraulic fluid in a hydraulic pipe to deliver valve-actuating force from a valve actuator located at a distal end of the hydraulic pipe (i.e., relative to the valve being actuated) to a valve follower located at a proximal end of the hydraulic pipe.

BACKGROUND

Current engine designs such as those used in automotive and many other applications typically use an in-line or "V" arrangement of multiple pistons. Cams on one or more camshafts are used to open and close each valve. These camshafts are aligned parallel to the crankshaft that controls the oscillatory motion of the pistons. They extend approximately the entire length of the engine. The possible locations of the camshafts are limited due to the need to arrange them in concert with the valves they operate.

The camshaft is sometimes located above the cylinder head (overhead cam) in close proximity to the valves it operates. One cam is located on the camshaft for each valve operated by the camshaft. Motion from the cam rotation is transferred to the valve by a mechanical lever known as a "rocker arm."

The camshaft may also be located in the cylinder block with one cam located on the camshaft for each valve it operates. Motion of the cam is transferred to a location near the valve it operates by a mechanical link called a "push rod." Motion from the push rod is transferred to the valve by a rocker arm in the same manner as described in the prior paragraph.

In modern engines, proper adjustment of the valve actuation mechanism is maintained by use of a small device called a "valve lifter" and is usually installed in the block or head between the cam and the push rod or valve rocker. This device uses engine oil that is supplied by the engine lubrication system.

In older engines, the camshaft was typically located in the engine block near the crankshaft. In this design, the timing of the valve opening and closing is accomplished by gears, one on the crankshaft (timing gear) and one on the camshaft. Newer engines typically have camshafts installed in the cylinder head (overhead cam), and timing is accomplished by connecting pulleys on the crankshaft and on the camshafts by a timing belt. Timing belts are subject to wear and failure and must be replaced at scheduled intervals. Replacement of a timing belt is a costly and inconvenient maintenance service.

SUMMARY

One aspect of the invention comprises a mechanism to operate internal combustion engine valves that includes an actuator, a hydraulic link (tube), and a follower to operate a valve. The actuator forces hydraulic fluid through the tube linking the actuator and the follower mechanism to open the valve. The valve is permitted to close when the fluid is released or allowed to flow in the reverse direction. The hydraulic fluid may be engine lubricating oil. This invention differs from prior art in that it uses hydraulic fluid as a link between an actuator and the valve follower mechanism rather than a mechanical link. The use of a hydraulic link permits designs that are not practical with valve actuation systems that use a mechanical link.

The actuator may be synchronized with the rotational component of the engine such as a crankshaft to open and close the valve at the appropriate phase of the engine combustion cycle. For example, the intake valve may open to allow air or a mixture of air and fuel to enter the combustion chamber and be closed the rest of the time. In another example, the exhaust valve may open to allow the products of combustion to exit the combustion chamber after the expansion cycle and be closed the rest of the time. Synchronization of the actuator and the engine may be accomplished either by a mechanical interface or an electronic control system.

One advantage of this invention is that it allows more flexibility in locating the actuator away from the valve (i.e., the valve being actuated by the actuator system) than the current technology using a mechanical linkage. This advantage is the result of using a hydraulic tube to route the hydraulic fluid from the actuator to the follower as needed in the same manner as an electrical wire. The actuator can be located almost any place on or near the engine so long as the linking tubes can be routed from the actuator to the valve. It is preferable that the location of the actuator be near the valve so that the length of the connecting tubes does not detract from the advantages of this system. Proper adjustment of this system to prevent "clacking" is inherent and no use of additional "valve lifters" is required.

There are various ways of designing the actuator and follower without departing from the design principles described in the above paragraphs. Two preferred embodiments of the actuator are presented in this disclosure along with one preferred example of the follower. The first embodiment of the actuator employs a cam as the driving force for the hydraulic fluid. This embodiment is termed the Preferred Exemplary Embodiment. The second embodiment of the actuator uses a source of hydraulic fluid at an appropriate pressure and a flow control mechanism operated by an electronic control system. This embodiment is termed the Alternate Actuator Embodiment.

The cam driven actuator (cam actuator) may use a single cam to operate all intake or exhaust valves in a multiple-cylinder engine regardless of firing order. Use of a single cam may significantly reduce the number of larger and expensive highly machined parts. A single-cam design for multiple valves is not practical in current engines that use a mechanical link between the actuator and the valve due to the requirement to accommodate engine cylinder firing order and geometric constraints.

The design flexibility of the hydraulic linkage according to the invention may also allow the actuator to be located so that gears can be used to operate the camshaft by the engine power shaft (such as a crankshaft) in virtually any engine configuration and avoid the need to use a timing belt or timing chain. Overhead cam designs in most current engines require either a timing belt or timing chain.

In one aspect, the invention provides a hydraulic valve actuator system for an internal combustion engine having at least one spring-biased valve movable between a closed position and an open position and a pressurized oil lubrication system. The hydraulic valve actuator system comprises an actuator assembly disposed at a first location relative to at least one spring-biased valve of an internal combustion engine. The actuator assembly includes an actuator housing defining a bore, an internal cavity holding a total volume of a hydraulic fluid, and an outlet port in fluid communication with the internal cavity. An actuator piston is slidably mounted in the bore of the actuator housing such that movement of the actuator piston between a first position relative to the actuator housing and a second position relative to the actuator housing will vary the total volume of the hydraulic fluid within the bore and internal cavity between a first value and a second value, respectively. The actuator piston is biased to move toward the first position relative to the actuator housing. A hydraulic pipe has a distal end in fluid connection with the outlet port of the actuator housing and a proximal end. A valve follower assembly is disposed at a second location relative to the at least one spring-biased valve, the second location being spaced-apart from the first location and closer to the at least one spring-biased valve than the first location. The valve follower assembly includes a follower housing defining a bore, an internal cavity holding a total volume of the hydraulic fluid, and an inlet port in fluid communication with the internal cavity. The inlet port is in fluid connection with the proximal end of the hydraulic pipe. A follower piston is slidably mounted in the bore of the follower housing such that movement of the follower piston between a first position relative to the follower housing and a second position relative to the follower housing will vary the total volume of hydraulic fluid within the bore and internal cavity between a first value and a second value, respectively. The follower piston is biased to move toward the second position relative to the follower housing. Movement of the actuator piston from its first position to its second position causes the hydraulic fluid to flow out of the actuator assembly, through the hydraulic pipe, and into the follower assembly such that the follower piston moves from its first position to its second position to move the at least one spring-biased valve from a first one of an open position or a closed position to the other of the open position or the closed position. Movement of the actuator piston from its second position to its first position causes the hydraulic fluid to flow out of the follower assembly, through the hydraulic pipe, and into the actuator assembly such that the follower piston moves from its second position to its first position to move the at least one spring-biased valve from the other of the open position or the closed position back to the first one of the open position or the closed position.

In another embodiment, the hydraulic valve actuator system further comprises an actuator spring mounted in the internal cavity of the actuator housing to bias the actuator piston toward the first position relative to the actuator housing.

In yet another embodiment, the hydraulic valve actuator system further comprises a follower spring mounted in the internal cavity of the follower housing to bias the follower piston toward the second position relative to the follower housing.

In another embodiment, the hydraulic fluid used in the valve actuator system is the oil used in the pressurized oil lubrication system of the internal combustion engine.

In yet another embodiment, the hydraulic fluid escaping from either of the internal cavity of the actuator housing or the internal cavity of the valve follower housing is collected for reuse in the pressurized oil lubrication system.

In still another embodiment, the actuator housing further comprises a make-up port defining a passageway from a source of hydraulic fluid to the internal cavity of the actuator housing. A check valve is connected to the make-up port. The check valve allows the hydraulic fluid to enter the internal cavity via the make-up port, but prevents the hydraulic fluid from leaving the internal cavity via the make-up port.

In another embodiment, the source of hydraulic fluid for the make-up port is the pressurized oil lubrication system of the internal combustion engine.

In another embodiment, the actuator assembly is disposed adjacent to a camshaft of an internal combustion engine and the follower assembly is disposed adjacent to a valve in a cylinder head of the internal combustion engine.

In another embodiment, the actuator assembly is disposed adjacent to a cam lobe on the camshaft of the internal combustion engine corresponding to the valve adjacent to which the follower assembly is disposed.

In still another embodiment, the actuator piston is operatively connected to a cam surface of a cam lobe of a rotating camshaft. The cam surface oscillates with respect to the actuator housing as the cam rotates. The actuator piston is repeatedly moved between its first position and its second position as the camshaft rotates.

In another aspect, the invention provides a hydraulic valve actuator system for an internal combustion engine having at least one spring-biased valve movable between a closed position and an open position and a pressurized oil lubrication system. The hydraulic valve actuator system comprises an actuator assembly disposed at a first location relative to at least one spring-biased valve of an internal combustion engine, the actuator assembly including a fluid control device defining an inlet port and an outlet port and being selectively switchable between at least two configurations corresponding to two different fluid flow states between the inlet port and the outlet port. A source of relatively high pressure hydraulic fluid is in fluid connection with the inlet port of the fluid control device. A controller device is operatively connected to the fluid control device and adapted to switch the fluid control device between the at least two configurations corresponding to the two different fluid flow states. A hydraulic pipe having a distal end is in fluid connection with the outlet port of the actuator assembly and has a proximal end. A valve follower assembly is disposed at a second location relative to the at least one spring-biased valve, the second location being spaced-apart from the first location and closer to the at least one spring-biased valve than the first location. The valve follower assembly includes a follower housing defining a bore, an internal cavity holding a total volume of the hydraulic fluid, and an inlet port in fluid communication with the internal cavity, the inlet port being in fluid connection with the proximal end of the hydraulic pipe. A follower piston is slidably mounted in the bore of the follower housing such that movement of the follower piston between a first position relative to the follower housing and a second position relative to the follower housing will vary the total volume of hydraulic fluid within the bore and internal cavity between a first value and a second value, respectively. The follower piston is biased to move toward the second position relative to the follower housing. Switching the fluid control device from its first configuration to its second configuration causes the hydraulic fluid to flow out of the actuator assembly, through the hydraulic pipe, and into the follower assembly at relatively high pressure such that the follower piston moves from its first position to its second position to move the at least one spring-biased valve from a first one of an open position or a closed position to the other of the open position or the closed position. Switching the fluid control device from it second configuration to its first configuration causes the hydraulic fluid to flow out of the follower assembly, through the hydraulic pipe, and back into the actuator assembly at relatively low pressure such that the follower piston moves from its second position to its first position to move the at least one spring-biased valve from the other of the open position or the closed position back to the first one of the open position or the closed position.

In another embodiment, the controller device of the actuator assembly is an electronic controller adapted to switch the configuration of the fluid control device so as to affect at least one of valve timing, rate of valve opening and closing; and/or valve travel.

In yet another embodiment, the fluid control device of the actuator assembly comprises a flow control housing defining an interior cavity, an inlet port and an outlet port. A shuttle is slidably disposed in the interior cavity of the flow control housing so as to be movable between at least two configurations, the shuttle having a cross-passage thereupon. When the shuttle is in one of the at least two configurations, the cross-passage of the shuttle is positioned so as to put the inlet port in fluid communication with the outlet port. When the shuttle is in the other of the at least two configurations, the cross-passage of the shuttle is positioned so as to block fluid communication between the inlet port and the outlet port.

In another embodiment, the flow control housing further defines a drain port connected to a relatively low pressure, and the shuttle further defines a drain passage formed thereupon. When the shuttle is in the other of the at least two configurations, the drain passage is positioned so provide fluid communication between the outlet port and the drain port.

In another embodiment, the controller device is operatively connected to the shuttle to move the shuttle back and forth in the passage of the flow control housing between the at least two configurations.

In yet another embodiment, the drain port is in fluid connection with a sump of the pressurized oil lubrication system of the internal combustion engine.

In still another aspect, the invention provides a hydraulic valve actuator system comprising an actuator assembly disposed at a first location and including an actuator housing defining a bore, an internal cavity suitable for holding a total volume of hydraulic fluid, and an outlet port in fluid communication with the internal cavity. An actuator piston is slidably mounted in the bore of the actuator housing such that movement of the actuator piston between a first position relative to the actuator housing and a second position relative to the actuator housing will vary the total volume of hydraulic fluid within the bore and internal cavity between a first value and a second value, respectively. The actuator piston is biased to move toward the first position relative to the actuator housing. A hydraulic pipe having a distal end is in fluid connection with the outlet port of the actuator housing and a proximal end. A valve follower assembly is disposed a second location, the second location being spaced-apart from the first location. The valve follower assembly includes a follower housing defining a bore, an internal cavity suitable for holding a total volume of hydraulic fluid, and an inlet port in fluid communication with the internal cavity, the inlet port being in fluid connection with the proximal end of the hydraulic pipe. A follower piston is slidably mounted in the bore of the follower housing such that movement of the follower piston between a first position relative to the follower housing and a second position relative to the follower housing will vary the total volume of hydraulic fluid within the bore and internal cavity between a first value and a second value, respectively. The follower piston is biased to move toward the first position relative to the follower housing. Movement of the actuator piston from its first position to its second position causes the hydraulic fluid to flow out of the actuator assembly, through the hydraulic pipe, and into the follower assembly such that the follower piston moves from its first position to its second position. Movement of the actuator piston from its second position to its first position causes the hydraulic fluid to flow out of the follower assembly, through the hydraulic pipe, and into the actuator assembly such that the follower piston moves from its second position to its first position.

BRIEF DESCRIPTION OF THE DRAWINGS

For a more complete understanding, reference is now made to the following description taken in conjunction with the accompanying Drawings in which:

FIGS. 2*a* and 2*b* show, respectively, a side view and a bottom view of a hydraulic tube that may be used in the embodiment of FIG. 1;

FIGS. 3*a* and 3*b* show, respectively, a top view and a side view of an actuator housing that may be used in the actuator assembly of FIG. 1;

FIGS. 4*a* and 4*b* show, respectively, a top view and a side view of an actuator spring that may be used in the actuator assembly of FIG. 1;

FIGS. 5*a* and 5*b* show, respectively, a top view and a side view of an actuator piston that may be used in the actuator assembly of FIG. 1;

FIG. 6 shows a side view of a cam of an internal combustion engine that may be used in the embodiment of FIG. 1;

FIGS. 7*a* and 7*b* show, respectively, a top view and a side view of a follower housing that may be used in the follower assembly of FIG. 1;

FIGS. 8*a* and 8*b* show, respectively, a top view and a side view of a follower spring that may be used in the follower assembly of FIG. 1;

FIGS. 9*a* and 9*b* show, respectively, a side view and a bottom view of an follower piston that may be used in the follower assembly of FIG. 1; and FIGS. 10*a*, 10*b* and 10*c* show, respectively, a top view, a side view and an end view of an actuator assembly in accordance with another embodiment.

DETAILED DESCRIPTION

Figure 1:
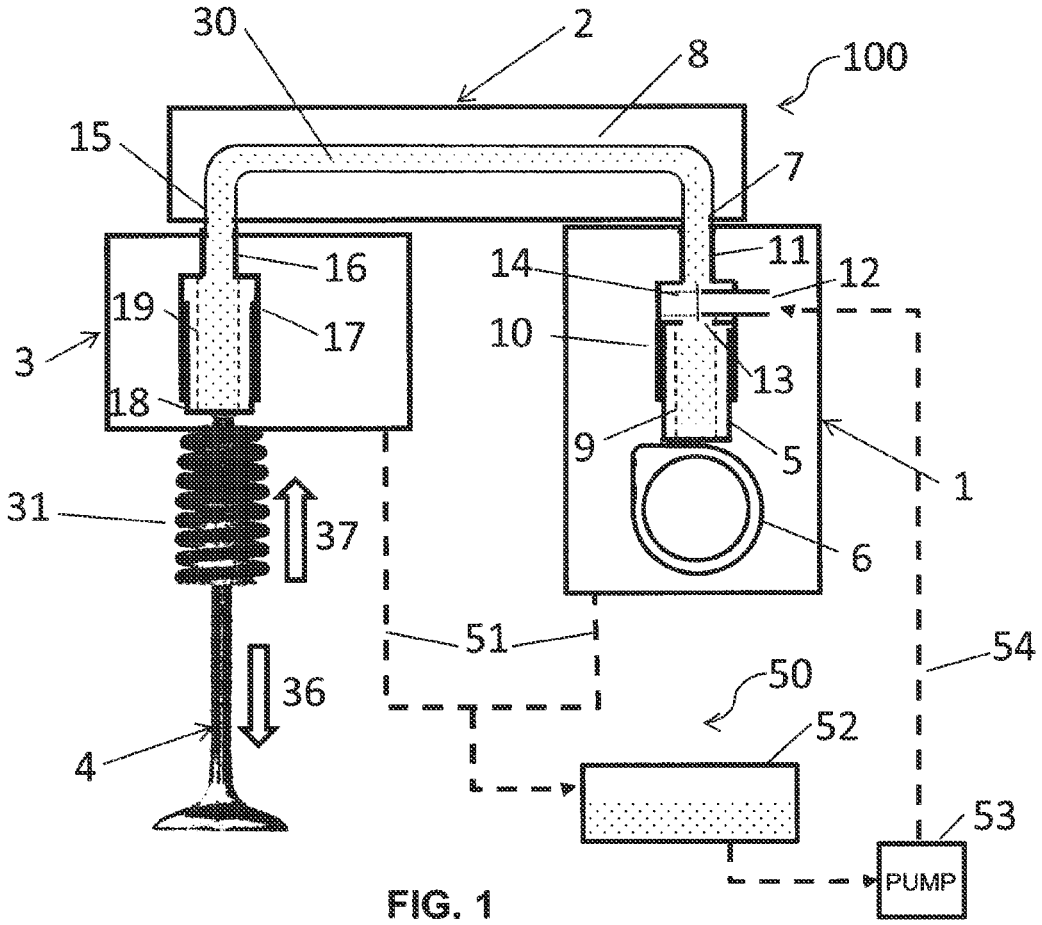
FIG. 1 shows a partial cut-away view of a hydraulic valve actuator system and portions of an engine in accordance with one embodiment of the current invention.

Referring now to the drawings, wherein like reference numbers are used herein to designate like elements throughout, the various views and embodiments of a hydraulic valve actuator system are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Referring now to FIG. 1, there is illustrated a Preferred Exemplary Embodiment of a hydraulic valve actuator system in accordance with one embodiment of the invention. Also illustrated in FIG. 1 are components (namely, a cam 6, a valve 4, a valve spring 31 and a pressurized oil lubrication system 50) of an internal combustion engine incorporating a hydraulic valve actuator system in accordance with another aspect of the invention. Other components of the internal combustion engine are not shown because they may be conventional. The illustrated hydraulic valve actuator system 100 includes an actuator assembly 1, a linking hydraulic tube (or pipe) 2 and a valve follower assembly 3. All internal spaces of these components (except for the cam 6) may be filled with a hydraulic fluid 30. In some embodiments, the hydraulic fluid 30 may be an engine lubricating oil of the type used in a pressurized oil lubrication system 50 for an internal combustion engine. In some such embodiments, the hydraulic fluid 30 may be part of the same fluid supply used for lubricating the engine; whereas in other embodiments, the valve actuator system 100 may use an oil supply that is independent of the oil in the engine lubricating system 50. In other applications, a separate hydraulic fluid 30 such as conventional hydraulic oil may be used.

The valve actuator system 100 provides force on the engine valve 4 to move the valve (i.e., in the direction indicated by arrow 36) against the bias (i.e., spring force 37) of the valve spring 31, thereby causing the valve to move from a closed position to an open position. For purposes of illustration, the hydraulic pipe 2 linking the valve actuator assembly 1 to the valve follower assembly 3 is depicted in FIG. 1 as being relatively short and relatively straight. It will be appreciated, however, that in various embodiments contemplated by the invention, the hydraulic pipe 2 may be relatively long and contain multiple complex curves, loops or other shapes. The valve follower assembly 3 will be located at the end (denoted 15) of the hydraulic pipe 2 that is proximal to the valve 4 being actuated, whereas the valve actuator assembly 1 will be located at the end (denoted 7) of the hydraulic pipe that is distal to the valve being actuated. The valve follower assembly will typically be located near a cylinder head (not shown) or other structure containing engine valves. The actuator assembly 1 will typically be located near a cam or camshaft of the engine or another source of power or pressure. In the embodiment illustrated in FIG. 1, the actuator assembly 1 is located adjacent to a cam 6, which is used as the driving force (i.e., power/pressure source) for the actuator assembly.

Although the actuator system 100 illustrated in FIG. 1 utilizes an actuator spring 9 to maintain contact between the actuator piston 5 and cam 6, in other embodiments, the actuator spring may be omitted from the actuator assembly 1 if another source of biasing force is provided for the actuator piston. For example, in some embodiments, the oil supply pressure of the hydraulic fluid 30 within the cavity 33 between the actuator housing 10 and the actuator piston 5 provides sufficient biasing force on the piston to maintain contact between the piston and the surface of the cam 6. In some embodiments, e.g., those where the hydraulic fluid 30 of the actuator system 100 and the lubricating oil of a pressurized oil lubrication system for an internal combustion engine utilize a common supply of oil, the engine oil supply pressure may be sufficient to provide the necessary biasing force for the actuator piston 5 without requiring a actuator spring 9. In still other embodiments, the actuator piston 5 may be biased using an external spring (not shown) or other known biasing technology.

Referring still to FIG. 1, and now also to FIGS. 2*a*, 2*b*, 3*a*, 3*b*, 4*a*, 4*b*, 5*a*, 5*b*, 6, 7*a*, 7*b*, 8*a*, 8*b*, 9*a* and 9*b*, there are illustrated details of the various components of the hydraulic valve actuator system 100 in accordance with this embodiment. Referring in particular to FIGS. 3*a*, 3*b*, 4*a*, 4*b*, 5*a* and 5*b*, the actuator assembly 1 comprises an actuator piston 5 in contact with the rotating cam 6 to periodically (i.e., as the cam rotates and the normal cam surface moves up and down (oscillates) relative to the actuator assembly) force hydraulic fluid 30 to flow into the distal end 7 of the linking tube 8 to open the valve 4. In this embodiment, the actuator piston 5 is configured as a cylindrical cup-shaped element having a closed end facing toward the cam 6 and an open end facing away from the cam. An actuator spring 9 keeps the piston 5 in contact with the surface of the rotating cam 6 at all times. The actuator spring 9 fits into an interior cavity 32 of the actuator piston 5, and both the actuator piston and actuator spring fit into a bore 33 of an actuator housing 10. Preferably, the actuator piston 5 is adapted to have sliding clearance in the bore 33 of the actuator housing 10 such that it can slide freely in the bore, but without allowing excessive leakage of pressurized hydraulic fluid 30 along the sliding joint.

When the oscillating normal surface of the cam 6 rises relative to the actuator assembly 1, it pushes the actuator piston 5 into the actuator housing 10. This forces the hydraulic fluid 30 inside the bore 33 out of the housing 10, through housing outlet 11 and into the distal end 7 of the linking tube 8. Subsequently, as the normal surface of the cam 6 falls relative to the actuator assembly 1, the actuator piston 5 moves out of the actuator housing 10, the hydraulic fluid 30 is allowed to flow back out of the linking tube 8 into the actuator housing (and allows the valve 4 to close as further explained below). A slight leakage of the hydraulic fluid 30 may occur by piston 5 in the actuator housing 10, and similarly by the follower piston 18 in the follower assembly 3. Lost (i.e., leaked) hydraulic fluid 30 from the actuator or follower assemblies 1 and 3 may be collected by one or more drain lines 51 and stored in a sump 52. In some embodiments, the sump 52 is the main sump of the lubricating system for the engine; whereas in other embodiments, the sump is only for hydraulic oil from the valve actuator system 100. The collected oil/hydraulic fluid may be pressurized by a pump 53 and delivered via a return line 54 for reuse in the hydraulic valve actuator system 100 and/or in the engine's main pressurized lubrication system (if separate). In some embodiments, the actuator system 100 may be replenished from fresh engine oil or another source of hydraulic fluid.

In the embodiment illustrated in FIG. 1, leaked hydraulic fluid 30 collected via collection lines 51, sump 52, pump 53 and return lines 54 is returned to the actuator system 100 through a make-up port 12 provided on the actuator assembly 1. A check valve 13 may be provided on the make-up port 12 to allow the hydraulic fluid 30 to enter the actuator housing 10 when the piston 5 is extending (i.e., during suction phase), while preventing the hydraulic fluid from being forced back into the engine oil supply when the cam 6 forces the piston 5 into the housing 10 (i.e., during compression phase). A spring 14 may be provided in the check valve 13 to keep the check valve closed except when the hydraulic fluid 30 is being replenished.

Referring now in particular to FIGS. 7*a*, 7*b*, 8*a*, 8*b*, 9*a* and 9*b*, there are further illustrated the components of the follower assembly 3. The follower assembly 3 may comprise a follower housing 17, follower piston 18 and a follower spring 19. In the illustrated embodiment, the proximal end 15 of the linking tube 8 is operatively connected to an inlet port 16 of the follower housing 17. In this embodiment, the follower piston 18 is configured as a cylindrical cup-shaped element having a closed end facing toward the valve 4 and an open end facing away from the valve. Further in this embodiment, the follower spring 19 fits into an interior cavity 34 of the follower piston 18, and both the follower piston and follower spring fit into a bore 35 of the follower housing 17. Preferably, the follower piston 18 is adapted to have sliding clearance in the bore 35 of the follower housing 17 such that it can slide freely in the bore, but without allowing excessive leakage of pressurized hydraulic fluid 30 along the sliding joint.

Although the actuator system 100 illustrated in FIG. 1 utilizes a follower spring 19 to maintain contact between the follower piston 18 and valve 4, in other embodiments, the follower spring may be omitted from the follower assembly 3 if another source of biasing force is provided for the follower piston. For example, in some embodiments, the oil supply pressure of the hydraulic fluid 30 within the cavity 35 between the follower housing 17 and the follower piston 18 provides sufficient biasing force on the piston to maintain contact between the piston and the stem of the valve 4. In some embodiments, e.g., those where the hydraulic fluid 30 of the actuator system 100 and the lubricating oil of a pressurized oil lubrication system for an internal combustion engine utilize a common supply of oil, the engine oil supply pressure may be sufficient to provide the necessary biasing force for the follower piston 18 without requiring a follower spring 19. In still other embodiments, the follower piston 18 may be biased using an external spring (not shown) or other known biasing technology.

The follower assembly 3 operates as follows: As the hydraulic fluid 30 is forced into the distal end 7 of the connecting tube 8 by the actuator piston 5, the hydraulic fluid flows from the proximal end 15 of the connecting tube, through the inlet port 16 and into the follower housing 17. The increasing amount of hydraulic fluid 30 in the follower housing 17 causes the follower piston 18 to extend from the housing and move (denoted by arrow 36 in FIG. 1) the valve 4 against the force 37 of the valve spring 31. The follower spring 19 ensures that follower piston 18 remains in contact with the valve 4. When the hydraulic fluid 30 is (subsequently) allowed to flow out of the follower housing 17, back through the pipe 8 and into the actuator housing 10, the spring force 37 of valve spring 31 against the valve 4 pushes the follower piston 18 back into follower housing 17 as it closes the valve 4.

It will be appreciated that the illustrated embodiment describes the operation of the hydraulic valve actuator system 100 with respect to a single valve 4. It will be readily apparent that any number of valves 4 may be actuated by providing additional actuator assemblies 1, hydraulic pipes 2 and valve follower assemblies 3 in accordance with the teachings of this disclosure. For example, one actuator assembly 1 of a plurality of actuator assemblies may be placed by each lobe of a camshaft, a corresponding one valve follower assembly 3 of a plurality of valve follower assemblies may be placed by each valve of a cylinder head, and one hydraulic pipe 2 of a plurality of hydraulic pipes may connect each respective valve follower assembly to the respective actuator assembly corresponding to the cam lobe associated with the respective valve.

Referring now to FIGS. 10*a*, 10*b* and 10*c*, there is illustrated an Alternate Actuator Embodiment of a hydraulic valve actuator system in accordance with another embodiment of the invention. The alternate actuator embodiment 200 may be used instead of the actuator assembly 1 in a hydraulic valve actuator system otherwise substantially similar to the system 100 as previously described. The alternate actuator embodiment 200 may also be used instead of the actuator assembly 1 in an internal combustion engine incorporating a hydraulic valve actuator system in accordance with another aspect of the invention.

The actuator assembly 200 of this embodiment may comprise a source (denoted by arrow 20) of high pressure hydraulic fluid 30, a fluid control device 21 and an electronic or mechanical controller device 23. In the illustrated example, the source 20 of high pressure hydraulic fluid 30 is supplied through an inlet port 38 to a fluid control device that includes a mechanical flow control housing 44. A shuttle 22 is disposed within a passageway 39 formed in the housing 44 and permitted to move (e.g., slidingly) back and forth (denoted by arrow 40) in the passageway. The controller device 23 is operatively connected to the fluid control device 21 to actuate the fluid control device in accordance with the desired valve movement.

In the illustrated embodiment, the controller device 23 moves the shuttle 22 in the control housing 44 to cause the valve 4 to open and close as follows: At one end of the shuttle 22 movement (denoted by double-arrow 40), a cross-passage 41 formed in the shuttle 22 is aligned with the inlet port 38 and an outlet port 42, thereby permitting the high pressure hydraulic fluid 30 to flow from the source 20 through the inlet port, cross-passage and outlet port into the linking tube 8 (which is operatively connected to the outlet port). The hydraulic fluid 30 may then flow at high pressure along the linking tube 8 and into the follower assembly 3 to actuate the valve 4 as previously described. At the other end of shuttle movement 40, a drain passage 43 formed in the shuttle 22 becomes aligned with the outlet port 42 at a first end and at a drain port 24 at a second end. The drain port 24 is maintained at a relatively low pressure compared to the fluid source 20, thereby permitting the hydraulic fluid 30 to flow back at low pressure out of the linking tube 8 such that the valve follower assembly 3 will allow the valve 4 to close under action of the valve spring 31. In some embodiments, the drain port 24 is connected to a sump 52 or a pump 53 (FIG. 1) of the pressurized oil lubrication system 50. It will be appreciated in FIGS. 10*a*, 10*b* and 10*c*, the fluid control device 21 is illustrated with the shuttle 22 in the second (i.e., drain) position such that the actuated valve would be closed (or in the process of closing).

As previously described, the movement 40 of the shuttle 22 may be controlled by the controller device 23. The controller device 23 may be electronic, electric or mechanical; it merely serves to switch the fluid control device 21 at the appropriate time to open and close the valve 4. In preferred embodiments, the controller device is an electronic control device that offers a wide variety of options for valve timing, rate of valve opening and closing and extent of valve travel. These features may be very important in high performance and high fuel efficiency engine designs.

It will be appreciated by those skilled in the art having the benefit of this disclosure that this hydraulic valve actuating system provides various embodiments for actuating systems, components of such systems and engines incorporating same. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A hydraulic valve actuator system for an internal combustion engine having at least one spring-biased valve movable between a closed position and an open position and a pressurized oil lubrication system, the hydraulic valve actuator system comprising:

an actuator assembly disposed at a first location relative to at least one spring-biased valve of an internal combustion engine, the actuator assembly including a fluid control device defining an inlet port and an outlet port and being selectively switchable between at least two configurations corresponding to two different fluid flow states between the inlet port and the outlet port, a source of relatively high pressure hydraulic fluid in fluid connection with the inlet port of the fluid control device, and a controller device operatively connected to the fluid control device and adapted to switch the fluid control device between the at least two configurations corresponding to the two different fluid flow states;

a hydraulic pipe having a distal end in fluid connection with the outlet port of the actuator assembly and a proximal end; and a valve follower assembly disposed at a second location relative to the at least one spring-biased valve, the second location being spaced-apart from the first location and closer to the at least one spring-biased valve than the first location, the valve follower assembly including a follower housing defining a bore, an internal cavity holding a total volume of the hydraulic fluid, and an inlet port in fluid communication with the internal cavity, the inlet port being in fluid connection with the proximal end of the hydraulic pipe;

a follower piston slidably mounted in the bore of the follower housing such that movement of the follower piston between a first position relative to the follower housing and a second position relative to the follower housing will vary the total volume of hydraulic fluid within the bore and internal cavity between a first value and a second value, respectively, and wherein the follower piston is biased to move toward the second position relative to the follower housing;

wherein switching the fluid control device from its first configuration to its second configuration causes the hydraulic fluid to flow out of the actuator assembly, through the hydraulic pipe, and into the follower assembly at relatively high pressure such that the follower piston moves from its first position to its second position to move the at least one spring-biased valve from a first one of an open position or a closed position to the other of the open position or the closed position; and wherein switching the fluid control device from it second configuration to its first configuration causes the hydraulic fluid to flow out of the follower assembly, through the hydraulic pipe, and back into the actuator assembly at relatively low pressure such that the follower piston moves from its second position to its first position to move the at least one spring-biased valve from the other of the open position or the closed position back to the first one of the open position or the closed position; and wherein the fluid control device of the actuator assembly comprises:

a flow control housing defining an interior cavity, an inlet port and an outlet port;

a shuttle slidably disposed in the interior cavity of the flow control housing so as to be movable between at least two configurations, the shuttle having a cross-passage thereupon;

wherein, when the shuttle is in one of the at least two configurations, the cross-passage of the shuttle is positioned so as to put the inlet port in fluid communication with the outlet port; and wherein, when the shuttle is in the other of the at least two configurations, the cross-passage of the shuttle is positioned so as to block fluid communication between the inlet port and the outlet port.

2. A hydraulic valve actuator system in accordance with claim 1, wherein:

the flow control housing further defines a drain port connected to a relatively low pressure; and the shuttle further defines a drain passage formed thereupon; and wherein, when the shuttle is in the other of the at least two configurations, the drain passage is positioned so provide fluid communication between the outlet port and the drain port.

3. A hydraulic valve actuator system in accordance with claim 2, wherein:

the controller device is operatively connected to the shuttle to move the shuttle back and forth in the passage of the flow control housing between the at least two configurations.

4. A hydraulic valve actuator system in accordance with claim 2, wherein:

the drain port is in fluid connection with a sump of the pressurized oil lubrication system of the internal combustion engine.

5. A hydraulic valve actuator system in accordance with claim 1, wherein the controller device of the actuator assembly is an electronic controller adapted to switch the configuration of the fluid control device so as to affect at least one of:

valve timing;

rate of valve opening and closing; and/or valve travel.

6. A hydraulic valve actuator system for an internal combustion engine having at least one spring-biased valve movable between a closed position and an open position and a pressurized oil lubrication system, the hydraulic valve actuator system comprising:

an actuator assembly disposed at a first location relative to at least one spring-biased valve of an internal combustion engine, the actuator assembly including a fluid control device having a flow control housing defining an interior cavity, an inlet port and an outlet port, a shuttle slidably disposed in the interior cavity of the flow control housing so as to be movable between at least two configurations, the shuttle having a cross-passage thereupon, wherein, when the shuttle is in one of the at least two configurations, the cross-passage of the shuttle is positioned so as to put the inlet port in fluid communication with the outlet port, and wherein, when the shuttle is in the other of the at least two configurations, the cross-passage of the shuttle is positioned so as to block fluid communication between the inlet port and the outlet port, a source of relatively high pressure hydraulic fluid in fluid connection with the inlet port of the fluid control device, and a controller device operatively connected to the fluid control device and adapted to switch the fluid control device between the at least two configurations corresponding to the two different fluid flow states;

a hydraulic pipe having a distal end in fluid connection with the outlet port of the actuator assembly and a proximal end; and a valve follower assembly disposed at a second location relative to the at least one spring-biased valve, the second location being spaced-apart from the first location and closer to the at least one spring-biased valve than the first location, the valve follower assembly including a follower housing defining a bore, an internal cavity holding a total volume of the hydraulic fluid, and an inlet port in fluid communication with the internal cavity, the inlet port being in fluid connection with the proximal end of the hydraulic pipe;

a follower piston slidably mounted in the bore of the follower housing such that movement of the follower piston between a first position relative to the follower housing and a second position relative to the follower housing will vary the total volume of hydraulic fluid within the bore and internal cavity between a first value and a second value, respectively, and wherein the follower piston is biased to move toward the second position relative to the follower housing.

7. A hydraulic valve actuator system in accordance with claim 6, wherein the controller device of the actuator assembly is an electronic controller adapted to switch the configuration of the fluid control device so as to affect at least one of:

valve timing;

rate of valve opening and closing; and/or valve travel.

* * * * *